US010883352B2

(12) United States Patent
Headrick

(10) Patent No.: US 10,883,352 B2
(45) Date of Patent: Jan. 5, 2021

(54) AUXILIARY ELECTRIC POWER SYSTEM FOR WELL STIMULATION OPERATIONS

(71) Applicant: Halliburton Energy Services, Inc., Houston, TX (US)

(72) Inventor: Dickey Charles Headrick, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 55 days.

(21) Appl. No.: 16/313,342

(22) PCT Filed: Aug. 12, 2016

(86) PCT No.: PCT/US2016/046765
§ 371 (c)(1),
(2) Date: Dec. 26, 2018

(87) PCT Pub. No.: WO2018/031031
PCT Pub. Date: Feb. 15, 2018

(65) Prior Publication Data

US 2019/0153843 A1 May 23, 2019

(51) Int. Cl.
*E21B 41/00* (2006.01)
*E21B 43/25* (2006.01)
*E21B 43/26* (2006.01)

(52) U.S. Cl.
CPC ..... *E21B 43/26* (2013.01); *E21B 41/0085* (2013.01); *E21B 43/25* (2013.01)

(58) Field of Classification Search
CPC ..... E21B 41/0085; E21B 43/25; E21B 43/26
See application file for complete search history.

(56) References Cited

U.S. PATENT DOCUMENTS 4,443,707 A * 4/1984 Scieri ..... F03B 13/06 290/4 A
4,818,475 A * 4/1989 Gluntz ..... G21C 15/18 376/282

(Continued)

FOREIGN PATENT DOCUMENTS

WO 1998/040603 A2 9/1998

OTHER PUBLICATIONS

International Search Report and Written Opinion issued in related PCT Application No. PCT/US2016/046765 dated May 10, 2017, 15 pages.

*Primary Examiner* — Matthew R Buck
(74) *Attorney, Agent, or Firm* — John W. Wustenberg; Baker Botts L.L.P.

(57) ABSTRACT

In accordance with presently disclosed embodiments, a system and method for using a central electric power generating system on a well stimulation location to drive the lower powered auxiliary systems on one or more mobile well stimulation equipment units is provided. The disclosed system may include an external electric power generating system for generating and outputting electric power, and a separate well stimulation equipment unit coupled to the external electric power generating system. The well stimulation equipment unit may include an on-board engine which provides motive energy to a high power component of the well stimulation equipment unit. The well stimulation equipment unit also includes a low power auxiliary system, which can be electrically coupled to the central electric power generating system. The central electric power generating system provides electric power for operating the low power auxiliary system.

20 Claims, 3 Drawing Sheets

(56) References Cited

U.S. PATENT DOCUMENTS

| | | | | |
|---|---|---|---|---|
| 7,769,537 | B2 * | 8/2010 | Gates | F02N 19/04 123/142.5 E |
| 8,794,307 | B2 | 8/2014 | Coquilleau et al. | |
| 9,140,110 | B2 * | 9/2015 | Coli | B01F 15/00538 |
| 9,394,770 | B2 * | 7/2016 | Boot | E21B 41/0085 |
| 2010/0000221 | A1 | 1/2010 | Pfefferle | |
| 2010/0038907 | A1 * | 2/2010 | Hunt | F02C 3/22 290/7 |
| 2015/0068808 | A1 | 3/2015 | Gard | |
| 2016/0208592 | A1 * | 7/2016 | Oehring | F04D 29/669 |

* cited by examiner

AUXILIARY ELECTRIC POWER SYSTEM FOR WELL STIMULATION OPERATIONS

CROSS-REFERENCE TO RELATED APPLICATION

The present application is a U.S. National Stage Application of International Application No. PCT/US2016/046765 filed Aug. 12, 2016, which is incorporated herein by reference in its entirety for all purposes.

TECHNICAL FIELD

The present disclosure relates generally to well stimulation operations, and more particularly, to a system and method for using a central electrical power generating system to drive low powered auxiliary systems on mobile well stimulation equipment units.

BACKGROUND

During the drilling and completion of oil and gas wells, various wellbore treatments are performed on the wells for a number of purposes. For example, hydrocarbon-producing wells are often stimulated by hydraulic well stimulation operations, where a servicing fluid such as a well stimulation fluid may be introduced into a portion of a subterranean formation penetrated by a wellbore at a hydraulic pressure sufficient to create or enhance fractures therein. Such a well stimulation treatment may increase hydrocarbon production from the well.

At a hydraulic well stimulation site, there are typically several large pieces of well stimulation equipment on location that must be powered including, but not limited to, a gel mixer, liquid handling equipment, sand handling equipment, a blender, a plurality of high pressure hydraulic pumping units, and a control center. The equipment on location is used to deliver large quantities of fluid/proppant mixtures to a wellhead at high pressures to perform the desired well stimulation operations.

Often, the hydraulic pumping units and other machinery on location are powered by diesel engines. In general, these diesel engines operate at relatively low efficiencies. The well stimulation site will often include several individual diesel powered units (e.g., pumping units, blenders, etc.) that must be refueled multiple times a day throughout a multi-stage well stimulation operation. These diesel powered units are often self-contained such that the diesel engine on each unit provides power to all operating systems on that unit.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
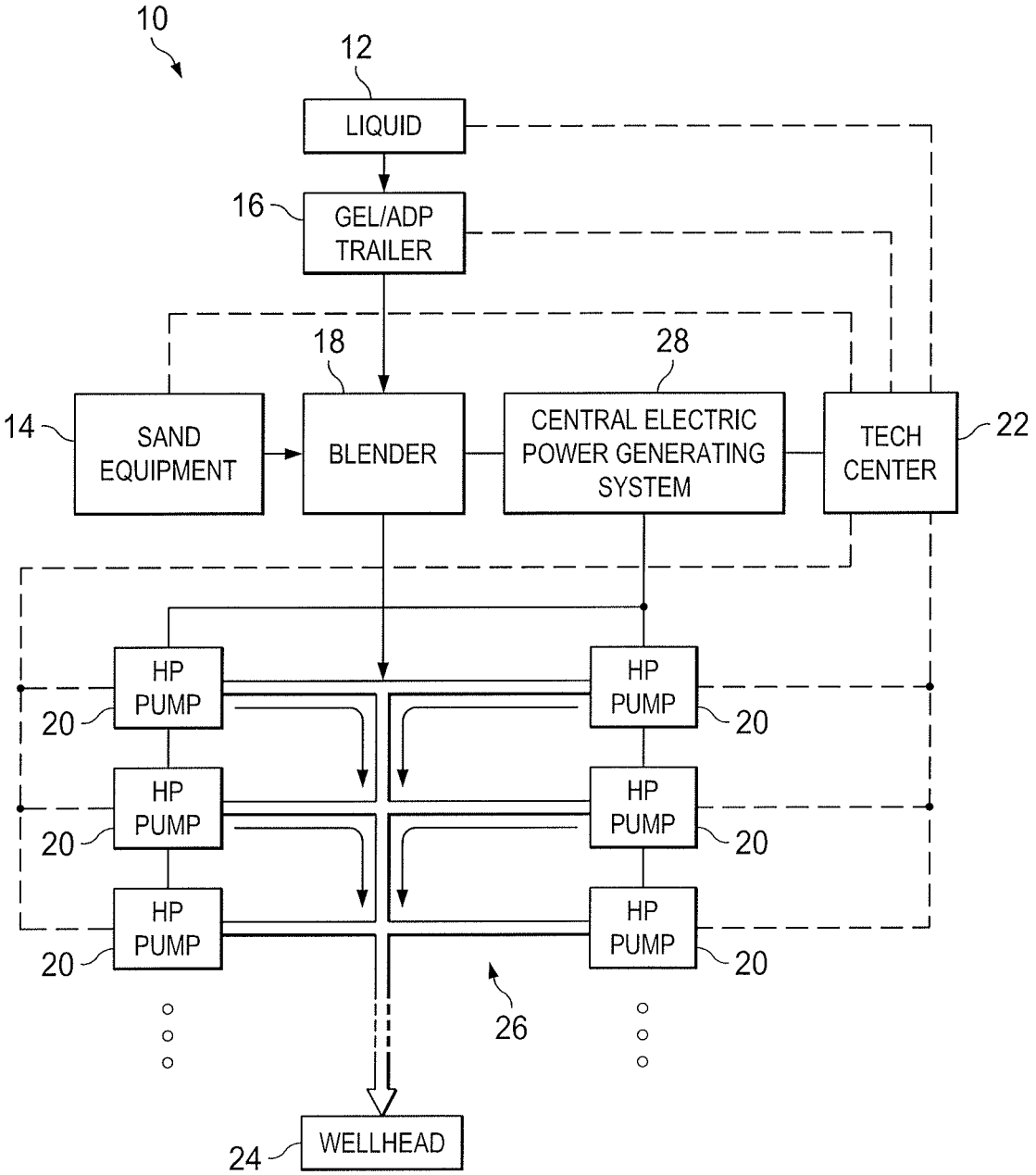
FIG. 1 is a schematic block diagram of a well stimulation spread where a centralized auxiliary electric power system may be employed, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for using a central electrical power generating system on a well stimulation location to drive low powered auxiliary systems on one or more mobile well stimulation equipment units. These units may include, for example, high pressure hydraulic pumping units, a blender, a gel mixer, proppant management units, job control cabins, as well as other types of equipment at the well stimulation site.

The disclosed systems may include an electric power generating system for generating and outputting electrical power, and a well stimulation equipment unit that is separate from and coupled to the electric power generating system. In some embodiments, the well stimulation equipment unit may include an on-board engine. The on-board engine may provide motive energy for operating a high powered component on the well stimulation equipment unit. The well stimulation equipment unit also includes one or more low power auxiliary systems, which may be electrically coupled to the electric power generating system or to the onboard electric power generating system. The central electric power generating system provides electrical power for operating the one or more low power auxiliary systems on the well stimulation equipment unit.

In some embodiments, the well stimulation equipment unit may be a high pressure hydraulic pumping unit. The on-board engine on the pumping unit may include a diesel engine powering a pump to output high pressure well stimulation fluid to a wellhead. The separate central electric power generating system may be used on location to provide electric power needed to run one or more low power auxiliary systems on the pumping unit, instead of relying on power from the on-board diesel engine.

Conventional pumping units used at a well stimulation site are generally self-contained, including a large diesel engine that provides power to not only operate the high pressure pump, but to circulate lubricant, keep oil heated, and perform other ancillary functions. This auxiliary power draw amounts to a parasitic load of approximately 10% or more of the available engine power when operating the pumping unit. When the high pressure pump is not on, the diesel engine on a conventional pumping unit is typically idled between pumping stages of a fracture treatment to keep the pumping units ready to perform the next pumping stage. This idle time can account for approximately 50-60% of the total engine running time.

The disclosed systems and methods for operating auxiliary systems on well stimulation equipment using a separate central electric power generating system may enable the diesel engines on the pumping units and other equipment to be fully shut down between pumping stages of the well stimulation operation, rather than running the engines at idle. In addition, the parasitic loads on the prime mover of the well stimulation equipment unit may be eliminated, thereby allowing the on-board engines to provide greater power to operate the pumps and other well stimulation equipment components.

Turning now to the drawings, FIG. 1 is a block diagram of a well stimulation equipment spread 10 used in hydraulic well stimulation of a well. The well stimulation spread 10 may include liquid handling equipment 12, sand handling equipment 14, gel/advanced dry polymer (ADP) handling equipment 16 (e.g., gel/ADP trailer), a blender unit 18, a plurality of high pressure hydraulic pumping units 20, a control center 22, and a wellhead 24. In some embodiments, the well stimulation spread 10 may not include all of the components illustrated. For example, the well stimulation spread 10 may not include the illustrated gel/ADP trailer 16 when a gel mixture or ADP mixture is not needed to create a desired treatment fluid. In some embodiments, one or more of the illustrated well stimulation equipment components may be separated into two or more separate units. In still other embodiments, two or more of the illustrated well stimulation equipment component may be incorporated into a single unit. It should be noted that additional well stimulation equipment components not shown in FIG. 1 may be located at the well site as well, and different numbers and arrangement of the illustrated well stimulation equipment may be used.

In a general well stimulation operation, the liquid handling equipment 12 may provide water that is entirely made up of potable water, freshwater, and/or treated water for mixing a desired treatment fluid. Other liquid may be provided from the liquid handling equipment 12 as well. The water (or other liquid) may be mixed with a viscosity-increasing agent in the gel/ADP trailer 16 to provide a higher viscosity fluid to help suspend sand or other particulate. The sand handling equipment 14 may output dry bulk material such as sand, proppant, and/or other particulate into the blender unit 18 at a metered rate. The blender unit 18 may mix the sand with the higher-viscosity water-based fluid in a mixing compartment to form a treatment fluid for stimulating the well.

The blender unit 18 may be coupled to an array of high pressure hydraulic pumping units 20 via a manifold 26. Although only six high pressure hydraulic pumping units 20 are illustrated, several more pumping units 20 may be positioned on location. The high pressure hydraulic pumping units 20 are arranged in parallel and used to deliver the treatment fluid to the wellhead 24 such that the treatment fluid is pumped into the wellbore at a desired pressure for stimulating the well.

The control center 22 may be communicatively coupled to various sensing and/or control components on the other well stimulation equipment. The control center 22 may include data acquisition components and one or more processing components used to interpret sensor feedback and monitor the operational states of the well stimulation equipment located at the well site. In some embodiments, the control center 22 may output control signals to one or more actuation components of the well stimulation equipment to control the well stimulation operation based on the sensor feedback.

At the well stimulation spread 10, many of the large well stimulation equipment components (e.g., liquid handling unit 12, sand handling equipment 14, gel/ADP trailer 16, blender unit 18, high pressure pumping units 20, and tech center 22) may be electrically powered but are often powered by internal combustion engines. The power requirements for these components together may be on the order of approximately 30 Megawatts.

The disclosed embodiments are directed to a central electric power generating system 28 used on location to drive various lower powered auxiliary systems on the mobile well stimulation equipment present in the well stimulation spread 10. The central electric power generating system 28 may be coupled to and used to power auxiliary systems on the liquid handling equipment 12, the sand handling equipment 14, the gel/ADP trailer 16, the blender unit 18, the high pressure hydraulic pumping units 20, the control center 22, or a combination thereof, or any other electrically powered well stimulation equipment on location. Multiple central electric power generating systems 28 may be disposed about the well stimulation spread 10 to supply power to the auxiliary systems.

Figure 2:
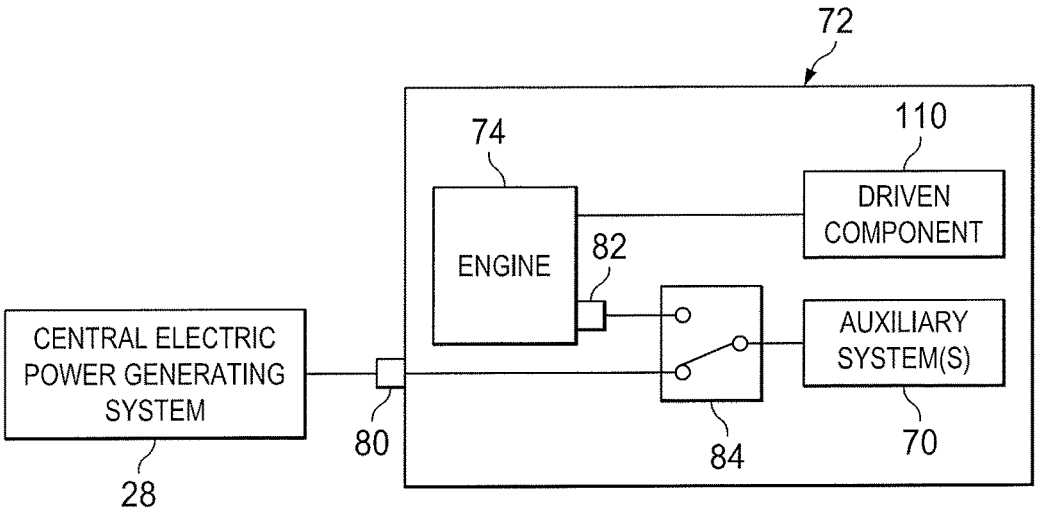
FIG. 2 is a schematic block diagram of an electric power generating system being used to provide power for operating auxiliary systems on a well stimulation equipment unit, in accordance with an embodiment of the present disclosure.

FIG. 2 is a schematic block diagram illustrating the central electric power generating system 28 being used to power one or more low power auxiliary systems 70 on a well stimulation equipment unit 72. In some embodiments, the well stimulation equipment unit 72 may be a high pressure hydraulic pumping unit 20 (or pump unit), as described above with reference to FIG. 1. However, the central electric power generating system 28 may similarly be used to provide energy for operating one or more auxiliary systems 70 on any other piece of well stimulation equipment 72 at the well site.

The well stimulation equipment unit 72 may include, among other things, an on-board engine 74 that operates a high powered system (driven component) 110 of the unit 72. For example, the on-board engine 74 may operate a hydraulic pump 78 (see FIG. 4) used to pump a treatment fluid toward a wellhead as described above. In general, the on-board engine 74 may generate mechanical energy by combustion of a fuel supplied to the engine 74. In some embodiments, the on-board engine 74 may be a diesel-powered engine.

Figure 4:
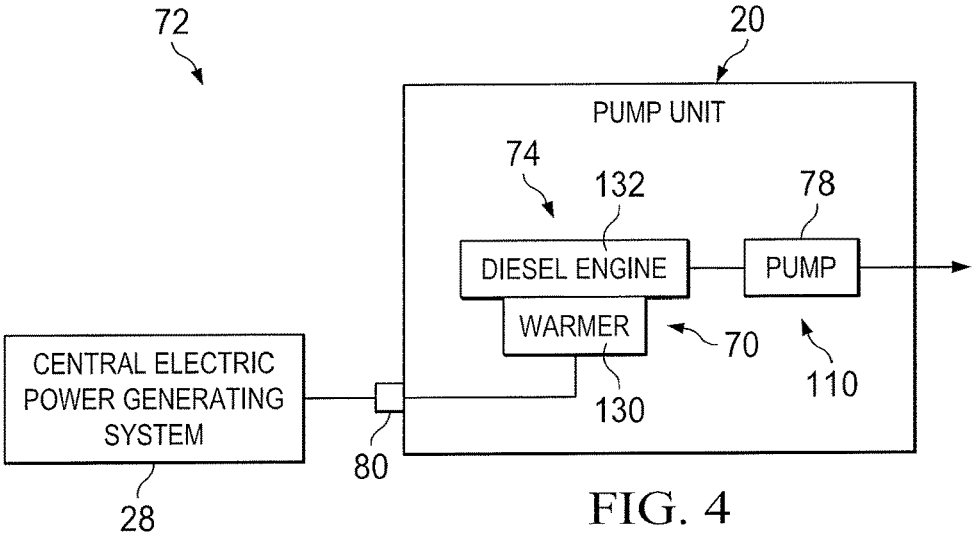
FIG. 4 is a schematic block diagram of an electric power generating system being used to provide power to an engine warmer on a diesel-powered hydraulic pump unit, in accordance with an embodiment of the present disclosure.

The pump 78 of FIG. 4 may be a reciprocating pump that uses mechanical energy from the on-board engine 74 to actuate a piston for pumping the treatment fluid toward the wellhead at relatively high pressures. The speed of the on-board engine 74 being used to operate the pump 78 may directly affect the pressure at which the treatment fluid is sent to the wellhead.

As shown in FIG. 2, the central electric power generating system 28 may be coupled to the well stimulation equipment unit 72 to provide electrical power for operating one or more auxiliary systems 70 on the well stimulation equipment unit 72. In the case of the high pressure hydraulic pumping unit 20, the term "auxiliary systems" may refer to any low power components or systems present on the pumping unit 20 that are separate from the driven device 110. For example, the auxiliary systems 70 may include a warming system (described in detail below), a lubricant circulation system, sensing or control components, and any other systems on the well stimulation equipment unit 72 that require relatively low power to operate.

The disclosed central electric power generating system 28 may include one or more electrical power generating systems disposed on the well stimulation site. The central electric power generating system 28 may include any desirable type of electrical power system including, but not limited to, a turbine generator, one or more fuel cells, a diesel engine powered generator, a natural gas engine powered generator, a generator powered by one or more tractors, a generator on a nearby mobile well stimulation equipment unit, or a conventional grid when power is available. Combinations of these may be employed in the central electric power generating system 28 to provide low power to the connected well stimulation equipment unit 72. The central electric power generating system 28 may be simply one of the well stimulation equipment units 72 which has sufficient electric power generation to power other units and has been designated to run continuously for that purpose.

It may be desirable for the central electric power generating system 28 to output AC power to the well stimulation equipment unit 72, so that the power is usable for operating various on-board AC powered auxiliary systems 70. In other embodiments, the central electric power generating system 28 may output DC power to the well stimulation equipment unit 72, and the well stimulation equipment unit 72 may include an on-board DC/AC converter (not shown) to convert the DC power into properly conditioned AC power. In further embodiments, the central electric power generating system 28 may include an on-board DC/AC converter integrated therein to condition DC power output from a generating component (e.g., fuel cells) into the desirable AC power for use by the auxiliary systems 70. In still further embodiments, the auxiliary systems 70 may run off DC power output from the central electric power generating system 28.

The central electric power generating system 28 may be separate from and selectively hooked up to the individual well stimulation equipment unit 72, while the engine 74 is contained on the well stimulation equipment unit 72 itself. The on-board engine 74 may be used to power the corresponding high power component 110 (e.g., hydraulic pump 78), while the central electric power generating system 28 may be used to power the auxiliary systems 70 on the well stimulation equipment unit 72. In some embodiments, the central electric power generating system 28 may be selectively and removably coupled to the well stimulation equipment unit 72 via a removable connector 80, such as a quick connect component. The quick connect 80 may be used to easily establish electrical communication between the output of the central electric power generating system 28 and the well stimulation equipment unit 72.

In some embodiments, the low power auxiliary systems 70 on the well stimulation equipment unit 72 may be designed to receive power from either the on-board engine 74 or the external electric power generating system 28. When the on-board engine 74 is used to power the auxiliary systems 70, a portion of the mechanical energy output from the engine 74 may be converted to electrical energy via an on-board generator 82, and the on-board generator 82 provides electrical power to the auxiliary systems 70. The on-board generator 82 may be incorporated into the on-board engine 74 as shown. The total amount of energy needed to power the auxiliary systems 70 may be much smaller than the amount of energy output from the engine 74 to the driven device 110.

The well stimulation equipment unit 72 may include a switching device 84 used to selectively switch the power supply for the auxiliary systems 70 from the central electric generating system 28 to the on-board power generating system (generator) 82, and vice versa. Thus, the switching device 84 enables delivery of power from the central electric power generating unit 28 to the auxiliary systems 70 or delivery of power from the on-board generator 82 of the on-board engine 74 to the auxiliary systems 70. The power supply (e.g., electric power generating system 28 or on-board generator 82) being used to power the auxiliary systems 70 may be selectable to increase the convenience and overall efficiency of the system operations. For example, it may be desirable to power the auxiliary systems 70 using on-board engine power when the well stimulation equipment unit 72 is brought to a maintenance facility or other location that is away from the on-site central electric power generating system 28. The switch 84 may include features to sense whether power is available from a central electric power generating system 28 and to automatically change between onboard and external power generation.

Figure 3:
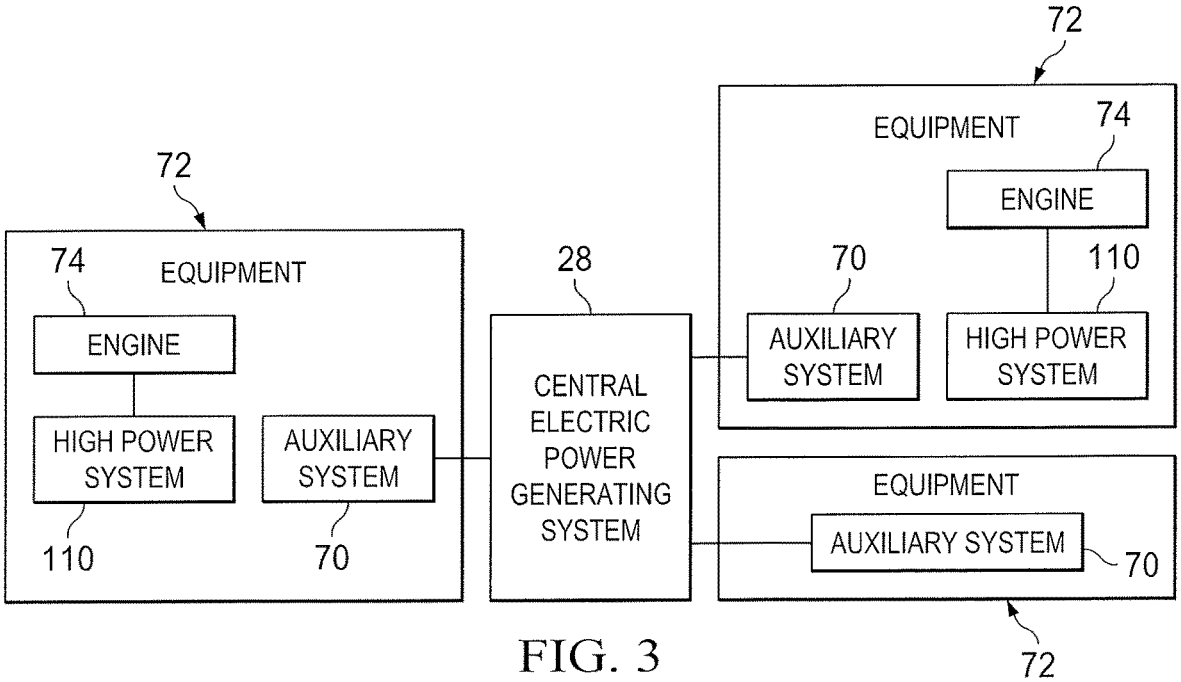
FIG. 3 is a schematic block diagram of an electric power generating system being used to provide power for operating auxiliary systems on multiple pieces of well stimulation equipment, in accordance with an embodiment of the present disclosure.

As shown in FIG. 2, the standalone electric power generating system 28 may be used to power auxiliary systems 70 on just a single piece of well stimulation equipment 72 at the well site. However, as shown in FIGS. 1 and 3, the central electric power generating system 28 may be coupled to and used to power auxiliary systems 70 on multiple pieces of well stimulation equipment 72 at the well site. The shared electric power generating system 28 may be centrally located on the well stimulation site to provide easy access for coupling it to the various equipment units 72. In some embodiments, just one or two central electric power generating systems 28 may be disposed at the well stimulation location and used to power all the low power components (e.g., fans, lubricant circulation systems, low power systems on the blender, etc.) of the well stimulation equipment 72 on location.

As shown, one or more of the well stimulation equipment units 72 may include an on-board engine 74, which is used to supply operating power to the high power system 110 (e.g., reciprocating pump, blender mixer, etc.) on the equipment unit 72. In some embodiments, at least one of the well stimulation equipment units 72 coupled to the central electric power generating system 28 may include just auxiliary systems 70 that are fully powered by the central electric power generating system 28. This may be the case, for example, with the control center 22 of FIG. 1, which includes generally low power data acquisition and control systems, without any large pumps or other high power components.

Having described the general operation of the central electric power generation system 28 used to power auxiliary systems on one or more well stimulation equipment units 72, a specific implementation of this arrangement and operation will now be described. FIG. 4 illustrates an embodiment of the central electric power generating system 28 being used to provide electrical power for operating a specific auxiliary system 70 on a high pressure hydraulic pumping unit 20. The auxiliary system 70 being powered in this embodiment is a warmer system 130 used to keep engine fluids warm so that a diesel engine 132 of the pump unit 20 may be kept warm and ready for start-up. Similarly, the pump 78 may have a warmer powered by the external electric power generating system 28.

During well stimulation operations, certain pieces of equipment on location may be turned on and off frequently, including the pumps 78 operated via the pump units 20. This is because a fracture treatment may involve the introduction of high viscosity well stimulation fluids to the wellhead in multiple stages separated by intermittent periods of downtime. In traditional well stimulation operations, the diesel-powered pump units are often idled between subsequent pumping stages of the fracture treatment, so that the diesel engine remains ready to provide full pumping power to the pump as needed.

In the disclosed embodiment, however, the low power auxiliary systems 70 (including the warmer 130) may be powered by the separate electrical power source 28, which allows for more efficient use of the large diesel engine 132 incorporated on the pump unit 20. Specifically, the engine 132 does not have to be idled during the time between performing subsequent stages of a well stimulation operation. Instead, the separate electric power generating system 28 may be used to operate the warmer 130 to keep oil and other fluids heated so the diesel engine 132 can be started up relatively quickly. This enables a fast on/off operation for the diesel engine 132 used in the pump unit 20. This type of fast on/off operation would not be available in existing diesel powered units because these units typically rely on power from the engine itself to provide warming.

With the disclosed pump unit 20 electrically coupled to the central electric power generating system 28, the diesel engine 132 on the pump unit 20 may be left powered down until shortly before the well stimulation operation begins. As long as the central electric power generating system 28 provides power for operating the warmer 130 (and/or other auxiliary systems 70 in the pump unit 20), the diesel engine 132 will remain fire-up ready with no or very little idle time.

Using the disclosed separate electric power generating system 28 to operate the warmer 130 (and/or other auxiliary systems 70) may help to cut costs associated with running the large on-board diesel engine 132 for longer than necessary, since the engine 132 can be quickly turned on and off Smaller diesel engines 132 may be employed on pump units 20 disposed at a well location where one or more electric power generating systems 28 are used to provide auxiliary power to the pumps.

Figure 5:
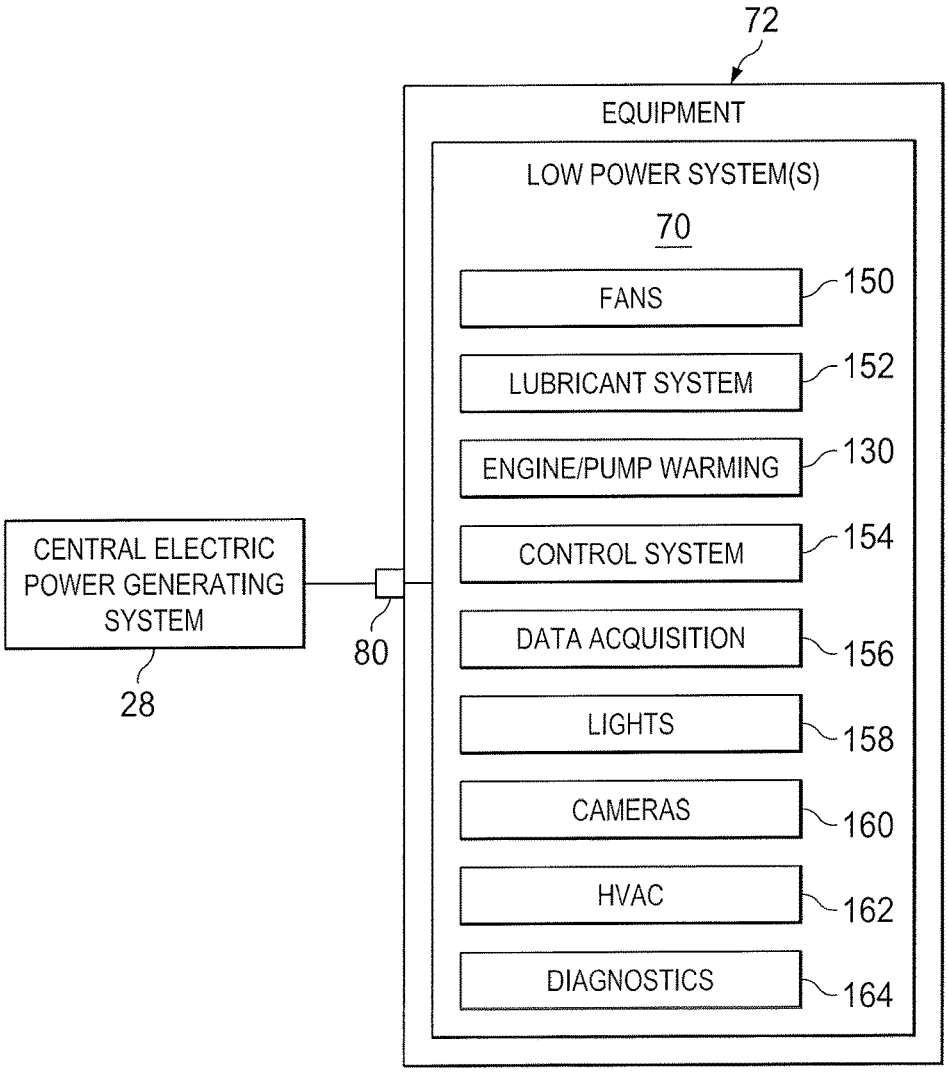
FIG. 5 is a schematic block diagram illustrating different auxiliary systems on well stimulation equipment that can be powered via a centralized electric power generating system, in accordance with an embodiment of the present disclosure.

As described above, the central power generating system 28 may be used to operate auxiliary power systems 70 on pumping units 20 as well as other well stimulation equipment units 72 (e.g., blender, sand handling unit, liquid handling unit, gel/ADP trailer, tech center, etc.) on location. FIG. 5 illustrates the central electric power generating system 28 being used to provide the desired low power for operating a variety of different types of auxiliary systems 70 that may be disposed on a well stimulation equipment unit 72.

As shown, the electrical power from the one or more generating systems 28 may be used to operate one or more fans 150 on the well stimulation equipment unit 72. The fans 150 may be used to provide cooling or other airflow to various component on the well stimulation equipment unit 72. In some embodiments, the central electric power generating system 28 may be used to provide power for operating a lubricant circulation system 152 designed to direct lubricant into an on-board engine (e.g., 74 of FIG. 2) or pump (e.g., 78 of FIG. 2) of the well stimulation equipment unit 72. Other low power auxiliary systems 70 that may be driven by a separate electric power source (e.g., power generating system 28) may be included on the well stimulation equipment 72. These may include, for example, an engine or pump warming system 130 as described above with reference to FIG. 4, a unit control system 154, a data acquisition system 156, one or more lights 158, one or more cameras 160, a heating ventilation air conditioning (HVAC) system 162 (e.g., for the control center cabin), or a diagnostics system 164.

One or more of these various auxiliary systems 70 (i.e., fans 150, lubricant system 152, engine/pump warming system 130, control system 154, data acquisition system 156, lights 158, cameras 160, HVAC 162, and diagnostics 164) may be disposed within a piece of well stimulation equipment 72 in any desired combination. Still other low power auxiliary systems 70 that are not mentioned here may be incorporated into a well stimulation equipment unit 72 and selectively run off power from the separate electric power generating system 28.

As described above with reference to FIG. 4, it is desirable to operate the warming system 130 of an on-board engine 132 of the well stimulation equipment unit 72 via the central electric power generating system 28 while the engine is off so that the oil remains heated for starting up the engine at a later time. For example, it is desirable to operate the warming system 130 on pumping units (e.g., 20 of FIG. 4) via the separate electric power generating system 28 at a time between pumping stages of a well stimulation treatment.

It may be desirable to operate other auxiliary systems 70 via the central electric power generating system 28 at the time between pumping stages as well. For example, maintenance items such as diagnostics systems 164 may be operated between pumping stages to monitor, test, and ensure that the pumps and other subsystems on the well stimulation equipment unit 72 are operating appropriately before beginning the next pumping interval. In addition, the central electric power generating system 28 may keep the data acquisition systems 156 operating even while the on-board engine is off so that data acquisition systems 156 can read various measurements (e.g., temperatures) between pumping stages. The control system 154 may be operated at this time as well to download information about the previous pumping stage collected from the data acquisition systems 156.

The external electric power source 28 may enable performance of auxiliary operations on well stimulation equipment units 72 in the time interval between pumping stages, while allowing the on-board engines to be turned off at this time. In addition, the external electric power source 28 may enable performance of auxiliary operations on the well stimulation equipment units 72 at times when the on-board engine is malfunctioning or will not run. Such auxiliary operations may include maintenance, data collection, monitoring diagnostics, remote start/stop of high powered diesel engines, and remote refueling, among others.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

an electric power generating system outputting electric power; and a well stimulation equipment unit coupled to the electric power generating system, wherein the well stimulation equipment unit is self-contained, and wherein the well stimulation equipment unit comprises:

an on-board engine that generates motive power by combustion of a fuel;

a high power component on the well stimulation equipment unit driven using the motive power generated by the on-board engine; and a low power auxiliary system electrically coupled to the electric power generating system, wherein the electric power generating system provides electric power for operating the low power auxiliary system.

2. The system of claim 1, wherein the well stimulation equipment unit comprises a unit selected from the group consisting of: a high pressure hydraulic pumping unit, a blender unit, a gel/advanced dry polymer (ADP) mixer, a sand handling unit, and a control center.

3. The system of claim 1, wherein the well stimulation equipment unit comprises a high pressure hydraulic pumping unit, and the on-board engine is coupled to a pump of the high pressure hydraulic pumping unit.

4. The system of claim 1, wherein the on-board engine comprises a diesel engine, and wherein the low power auxiliary system comprises an engine warming system.

5. The system of claim 1, wherein the well stimulation equipment unit further comprises an on-board electric power generator incorporated into the on-board engine wherein the on-board electric power generator selectively provides power to the low power auxiliary system.

6. The system of claim 1, wherein the low power auxiliary system comprises at least one selected from the group consisting of: a fan, a lubricant circulation system, an engine or pump warming system, a control system, a data acquisition system, a light, a camera, a HVAC system, an air compressor, a cooling system, a hydraulic system, a mixing system, a material conveyance system, and a diagnostics system.

7. The system of claim 1, further comprising a plurality of well stimulation equipment units coupled to the electric power generating system, wherein the electric power generating system provides power for operating low power auxiliary systems on each of the plurality of well stimulation equipment units.

8. The system of claim 1, wherein the electric power generating system comprises at least one selected from the group consisting of: a turbine generator, fuel cells, a diesel engine powered generator, a natural gas engine powered generator, a generator powered by tractors, a mobile well stimulation equipment unit, or an electric power grid.

9. The system of claim 1, further comprising a quick connect for removably coupling the well stimulation equipment unit to an output of the electric power generating system.

10. A method, comprising:

outputting electric power from an external electric power generating system to a well stimulation equipment unit that is separate from the external electric power generating system, wherein the well stimulation equipment unit is self-contained;

generating motive power by combustion of a fuel via an on-board engine of the well stimulation equipment unit;

driving a high power component of the well stimulation equipment unit using the motive power from the on-board engine; and powering a low power auxiliary system of the well stimulation equipment unit via the electric power output from the external electric power generating system.

11. The method of claim 10, further comprising switching between powering the low power auxiliary system via the external electric power generating system and powering the low power auxiliary system via power output from an on-board electric power generating system incorporated into the on-board engine.

12. The method of claim 11, further comprising sensing whether power is available from the external electric power generating system and switching from powering the low power auxiliary system via the on-board engine to powering the low power auxiliary system via the external electric power generating system when power is available.

13. The method of claim 10, further comprising outputting electric power from the external electric power generating system to multiple well stimulation equipment units, and powering low power auxiliary systems on each of the multiple well stimulation equipment units via the external electric power output from the external electric power generating system.

14. The method of claim 10, further comprising powering an engine warming system on the well stimulation equipment unit via the electric power output from the external electric power generating system, and warming the on-board engine via the engine warming system.

15. The method of claim 14, further comprising powering the engine warming system via the external electric power generating system when the on-board engine is turned off.

16. The method of claim 14, further comprising outputting the motive power from the on-board engine to a reciprocating pump of the well stimulation equipment unit, and pumping a well stimulation treatment to a wellhead via the reciprocating pump.

17. The method of claim 16, further comprising turning the on-board engine completely off after the end of a pumping stage performed by the well stimulation equipment unit, and turning the on-board engine on before beginning a next pumping stage.

18. The method of claim 10, wherein powering the low power auxiliary system comprises powering at least one selected from the group consisting of: a fan, a lubricant circulation system, an engine or pump warming system, a control system, a data acquisition system, a light, a camera, a HVAC system, and a diagnostics system.

19. The method of claim 10, further comprising removably coupling the well stimulation equipment unit to the external electric power generating system via a quick connect.

20. The method of claim 10, wherein the well stimulation equipment unit comprises a unit selected from the group consisting of: a high pressure hydraulic pumping unit, a blender unit, a gel/advanced dry polymer (ADP) mixer, a sand handling unit, and a control center.

* * * * *